US006538528B2

(12) United States Patent
Louzir et al.

(10) Patent No.: US 6,538,528 B2
(45) Date of Patent: Mar. 25, 2003

(54) T-CIRCUIT PRODUCED USING MICROSTRIP TECHNOLOGY WITH A PHASE-SHIFTING ELEMENT

(75) Inventors: Ali Louzir, Rennes (FR); Philippe Minard, Rennes (FR); Jean-François Pintos, Rennes (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/894,366

(22) Filed: Jun. 28, 2001

(65) Prior Publication Data

US 2002/0024405 A1 Feb. 28, 2002

(30) Foreign Application Priority Data

Jun. 29, 2000 (FR) ..... 00 08363

(51) Int. Cl.[7] ..... H01P 1/18
(52) U.S. Cl. ..... 333/128; 333/136; 333/161
(58) Field of Search ..... 333/128, 161, 333/136, 26

(56) References Cited

U.S. PATENT DOCUMENTS 4,577,167 A * 3/1986 Evans ..... 333/128
4,901,042 A * 2/1990 Terakawa et al. ..... 333/127
4,967,172 A 10/1990 Ariel et al. ..... 333/161
5,216,430 A 6/1993 Rahm et al. ..... 343/700
5,889,444 A * 3/1999 Johnson et al. ..... 333/127
6,320,478 B1 * 11/2001 Sims, III ..... 333/127

OTHER PUBLICATIONS

Patent Abstracts of Japan, vol. 017, No. 035, Jan. 22, 1993 & JP 04 256201A of Sep. 10, 1992.

Patent Abstracts of Japan, vol. 017, No. 487, Sep. 3, 1993 & JP 05 121935 of May 18, 1993.

French Search Report citing the above–listed documents: AA, AB, AI and AJ.

* cited by examiner

*Primary Examiner*—Michael Tokar
*Assistant Examiner*—Vibol Tan
(74) *Attorney, Agent, or Firm*—Joseph S. Tripoli; Kuniyuki Akiyama

(57) ABSTRACT

The present invention relates to a T-circuit produced using microstrip technology with two branches (2, 3) of identical length L2 comprising a phase-shifting element (6) producing a given phase shift Φ by extending one of the branches, the T-circuit operating in broadband, the circuit comprises at least one elbow (4) extending the branch (3) without the phase-shifting element and the length L2 is equal to a multiple of λg/2 where λg is the guided wavelength.

6 Claims, 4 Drawing Sheets

T-CIRCUIT PRODUCED USING MICROSTRIP TECHNOLOGY WITH A PHASE-SHIFTING ELEMENT

FIELD OF THE INVENTION

The present invention relates to T-circuits produced using microstrip technology and comprising a phase-shifting element that gives a given phase shift, the T-circuit operating in broadband.

BACKGROUND OF THE INVENTION

The present invention applies in particular to the field of broadband antenna networks. In this type of network, the width of the frequency band is often limited by the bandwidth of the elemental radiating element and by the bandwidth of the supply network. This is particularly the case when use is made of a phase shift in the excitation of the radiating elements. This type of phase shift is used in particular when the radiating elements produced, for example using printed technology, are excited using the well-known technique of sequential rotation. For networks of radiating elements of the above type, the supply network is usually produced using microstrip technology and consists of at least one T-circuit connected via microstrip lines and bends to the various radiating elements. The supply network thus distributes the energy to each of the radiating elements. In order for these radiating elements to be excited with the desired phase, bits of line are added on one side of the T-circuit or circuits. However, this phase shift is valid only for a narrow frequency band.

The behavior of the micro strip lines of the T-circuits and of the bends is actually well known to those skilled in the art and provides an explanation for the operation over a narrow frequency band.

In the case of microstrip lines, a length of microstrip line introduces a phase shift $\Phi=\beta L$ where L is equal to the length of the line and $\beta$ is the phase constant. In a known way, $\beta$ depends on the substrate, on the frequency and on the width of the microstrip line. Its value is given by:

$$\beta=2\pi/\lambda g$$

where $\lambda g=\lambda 0/\sqrt{\epsilon_{reff}}$, $\lambda g$ being the guided wavelength.

In this formula, $\epsilon_r$ is the effective dielectric constant and depends on the width of the line, on the height of the substrate on which the line is produced, on the thickness of the metallization, on the dielectric constant of the substrate and on the wavelength, and $\lambda 0$ is the wavelength in a vacuum (associated with the frequency). This therefore explains why the lines do not have the same phase for different frequencies.

As is known, a T-circuit like the one depicted in FIG. 1, has equivalent line lengths between port 1 and port 2 and between port 1 and port 3. As a result, the value Ang(S21)–Ang(S31)=0, irrespective of the working frequency.

In addition, in a supply network produced using microstrip technology, use is also made of bent lines which, among other things, allow for changes in direction so that energy can be supplied to the radiating element. In terms of phase shift, it is possible to find a length of bend equivalent to the length of a line. Thus, the phase shift of bend is equal to $\Phi=\beta_{bend}\times L_{bend}$, where $\beta_{bend}$ is the phase constant in the bend and $L_{bend}$ is the electrical length in the bend.

As depicted in Figure 2, T-circuits comprising a phase-shifting element have already been and in that the produced in the prior art. These circuits are based on the principle of a T-circuit with lines of identical length L2 on each side of the exit from the T and followed by bent lines comprising bits of line L1 of identical length. The circuit will display a phase difference Ang(S31)–Ang(S21)=0, regardless of the frequency, if the length of the lines between port 1 and port 2 and between port 1 and port 3 is the same. As a result, in order to introduce a phase shift of a given value, for example of 180°, between the exit ports 2 and 3, all that is required is for one of the lines to be lengthened by a length L such that PL×180°. This can be done using bits of line on each side of a bend, of a length such that $\Phi\times180°$ and $\Phi$-1×0 °, as depicted in FIG. 2. However, all of the simulations carried out on such a T-circuit show that this condition is valid only for the central frequency and that the phase shift of 180° is no longer obtained when this central frequency is departed from.

BRIEF DESCRIPTION OF THE INVENTION

Thus, the object of the present invention is therefore to propose a T-circuit produced using microstrip technology comprising a phase-shifting element such that the T-circuit can operate over a large frequency band.

In consequence, a subject of the present invention is a T-circuit produced using microstrip technology with two branches of identical length L2 comprising a phase-shifting element producing a given phase shift $\Phi$ by extending one of the branches, the T-circuit operating in broadband, characterized in that it comprises at least one bend extending the branch without the phase-shifting element length L2 is equal to a multiple of $\lambda g/2$ where $\lambda g$ is the guided wavelength.

In this case, the phase-shifting element is formed by a microstrip line of length L $\times\Phi/\beta$ where $\beta$ is the phase constant, $\beta$ being calculated as mentioned here in above. As a preference, the phase-shifting element is extended by a line element of length L7 1 × L1 +$L_{bend}$ and the bend is extended by a line element of length L1, these elements for example allowing connection to radiating elements.

According to another feature of the present invention, the phase-shifting element is formed of a bend of a length such that a phase shift of $\Phi/2$ is distributed on each side of the bent. In this case, each bent is extended by a line element of identical length L1 for connection, for example, to a radiating element.

The present invention also relates to a supply circuit for a broadband antenna network produced using microstrip technology, characterized in that it comprises at least one T-circuit exhibiting the characteristics described hereinabove.

BRIEF DESCRIPTION OF THE DRAWINGS

Other characteristics and advantages of the present invention will become apparent upon reading various embodiments, this description being given with reference to the appended drawings, in which.

In the figures, the same elements carry the same references.

DESCRIPTION OF PREFERRED EMBODIMENTS

A first embodiment of a T-circuit with a phase-shifting element according to the present invention will be described first of all with reference to FIGS. 3 to 6.

Figure 1:
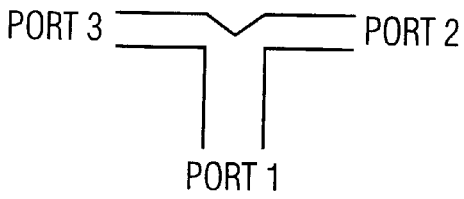
FIG. 1 PRIOR ART
FIG. 1, already described, is a diagrammatic view from above of a T-circuit according to the prior art, FIG. 2, already described, is a diagrammatic view from above of a T-circuit equipped with a phase-shifting element according to the prior art.
Figure 2:
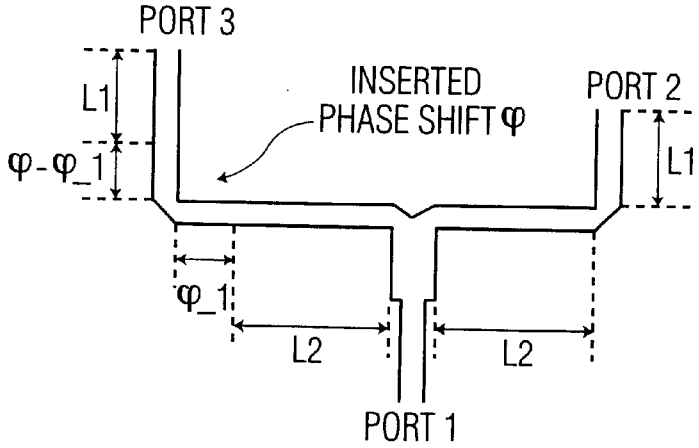
FIG. 2 PRIOR ART
Figure 3:
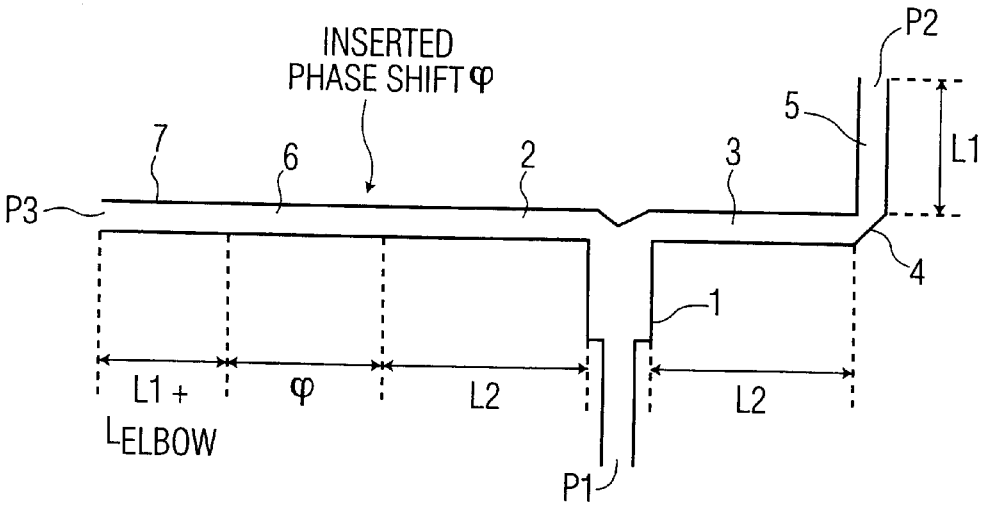
FIG. 3 is a diagrammatic view from above of a T-circuit according to a first embodiment of the present invention.

As depicted in FIG. 3, the T-circuit with a phase-shifting element comprises, in this instance, just one bend. More specifically, the T-circuit consists of a branch 1 comprising an entry port P1 and two perpendicular branches 2, 3 of the same length L2. According to the present invention, the length L2 is chosen so that it is a multiple of $\lambda g/2$ where $\lambda g$ is equal to the guided wavelength in the branches produced using microstrip technology.

As depicted in Figure 3, the branch 3 is extended by a bend 4 which itself is extended by a line element 5 of length L1 to reach the exit port P2. On the other hand, the other branch 2, according to the present invention, is extended by a line element 6 giving a phase shift of $\Phi$, then by a line element 7 of length L1 $+L_{bend}$ so as to arrive at the port P3. Line element 6 has a length L'such that $L'=\Phi/\beta$. In the embodiment depicted in FIG. 3, according to the present invention, the bent 4 is placed on the side of the shortest arm and the length L2 has to be a multiple of $\lambda g/2$.

Figure 4:
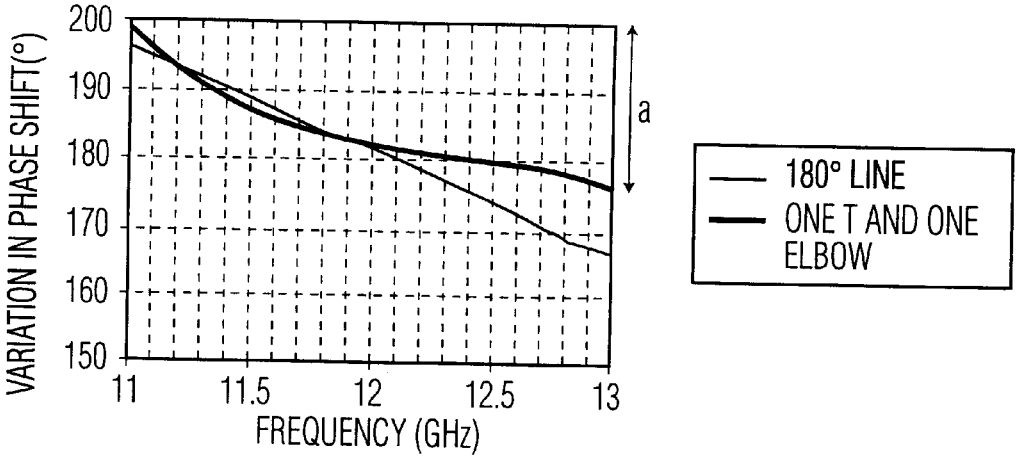
FIGS. 4, 5 and 6 are diagrams depicting the variation in phase shift of the circuit of FIG. 3, respectively in the case of a circuit in accordance with the present invention and, by way of comparison, with conventional circuits.
Figure 5:
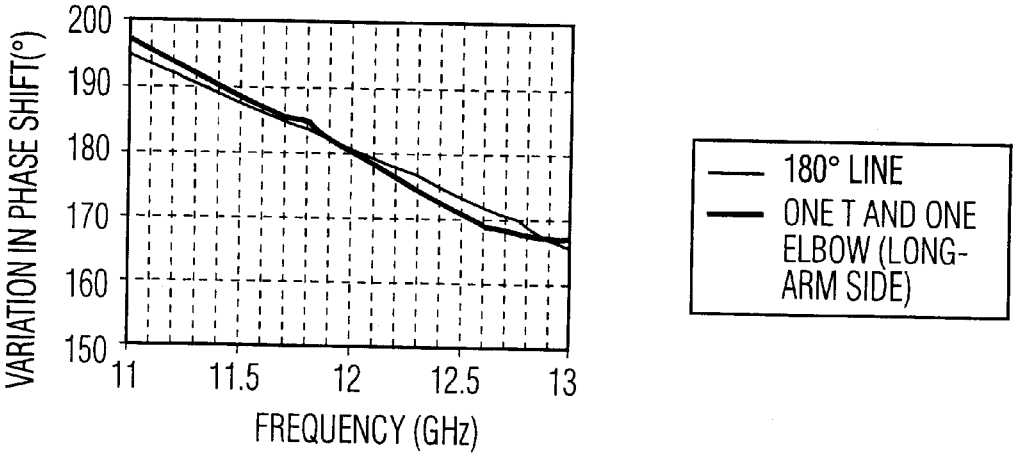
Figure 6:
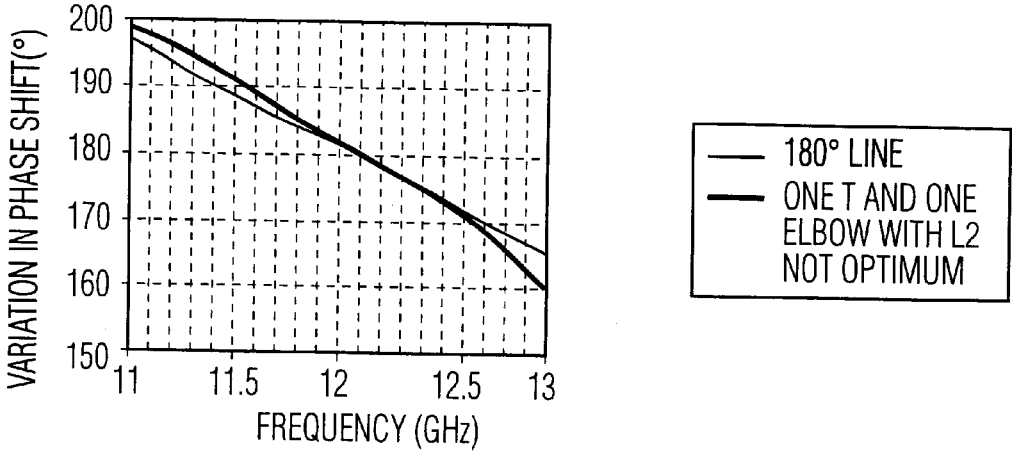

The advantages of such a structure will become apparent following simulations carried out using commercially available software such as IE3D or HPESSOF, these simulation results being depicted in FIGS. 4, 5 and 6. These simulations were carried out by producing the T-circuit with a phase-shifting element on a Rogers 4003 substrate having an $\epsilon_r$ of 3.38, a height equal to 0.81 mm, a tangent $\Delta$ of 0.0022 and T=17.5 micrometers. In this case, the width of the 50 ohm line used for the simulations was W=1.5 mm.

A T-circuit with a phase-shifting element with one bend, in which the variation in the phase shift of the T with the phase-shifting element with one bend is compared with a line of length L such that $\beta L \times 180°$, is depicted in FIG. 4. In this case, it can be seen that the variation in phase is equal to 23° rather than 30° over a bandwidth of between 11 and 13 GHz.

FIGS. 5 and 6 depict the variation in phase shift of a phase-shifting T with one bend designed according to other rules. Thus, in FIG. 5, the bend is not placed on the same side as the arm 3, as depicted in FIG. 3, but in place of the line element $\Phi$, the branch 3 being extended by a line element of the type of the element 7. In this case, it can be seen that the phase shift of the T-circuit is more or less identical to that of the line at 180°.

FIG. 6 depicts the case of a T-circuit with a phase-shifting element with one elbow in which the length of each branch L2 is other than $\lambda g/2$. The results of the simulation show that the variation in phase shift with frequency exceeds the phase shift of a line of length 180°.

Figure 7:
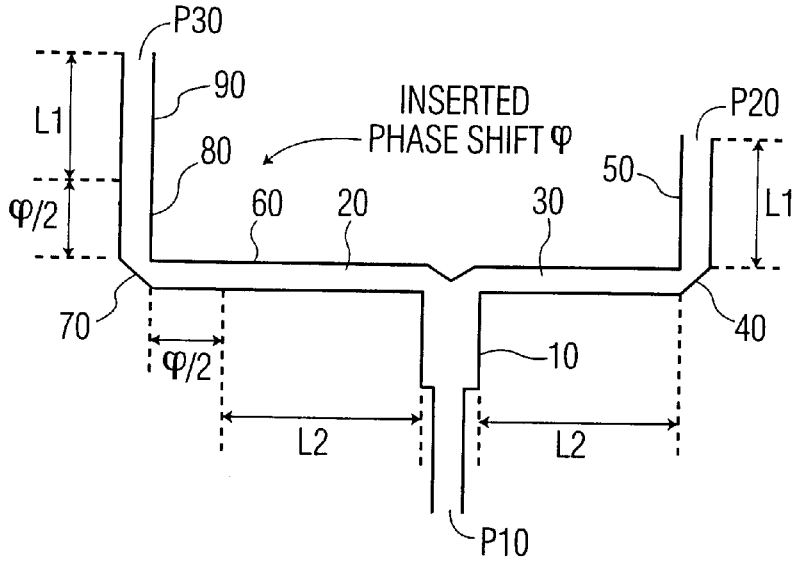
FIG. 7 is a diagrammatic view from above of a T-circuit according to another embodiment of the present invention.

Another embodiment of a T-circuit with a phase-shifting element according to the present invention will now be described with reference to FIGS. 7, 8, 9 and 10. In this case, as depicted in FIG. 7, the T-circuit comprises two bends 40, 70. More specifically, the circuit in FIG. 7 comprises an entry branch 10 to the T, connected to the entry port 10 and two perpendicular branches 20, 30 which, according to the present invention, have the same length L2 equal to a multiple of $\lambda g/2$.

As depicted in FIG. 7, the branch 30 is extended by a bend 40 and a line element 50 of length L1 to arrive at an exit port P20. On the other hand, the branch 20 is extended by a bend 70 preceded and followed by line elements 60 and 80 which make it possible to obtain the phase shift $\Phi$. According to the present invention, the elements 60 and 80 are produced in such a way as to give each a phase shift identical to $\Phi/2$. Furthermore, the element 80 is extended by a line element 90 of length L1 arriving at a port P30.

Figure 8:
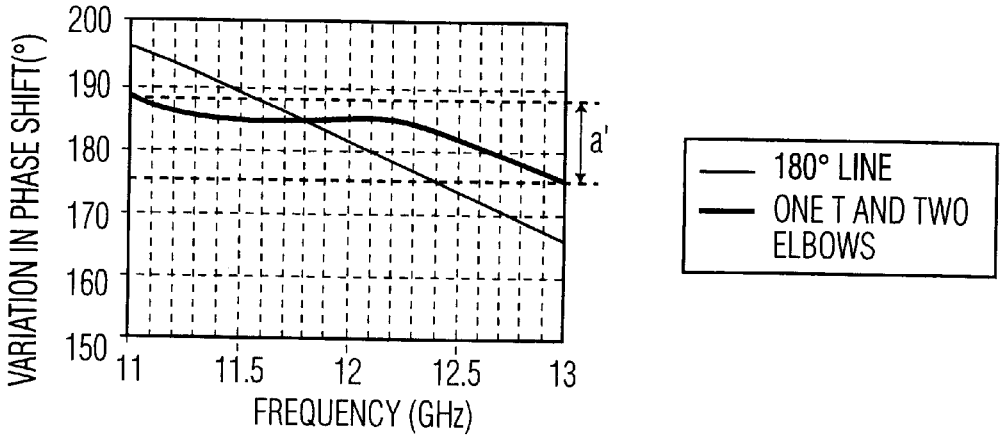
FIGS. 8, 9 and 10 are diagrams depicting the variation in phase shift of the circuit of FIG. 7, respectively in the case of a circuit in accordance with the present invention and, by way of comparison, with conventional circuits.

Simulations have been carried out in the same way as the simulations carried out with the first embodiment. Thus, FIG. 8 depicts the variation in phase shift of a T-circuit as a function of frequency, according to the above embodiment. In this case, the variation in phase shift of a T-circuit with a phase-shifting element comprising two bends is compared with a line of length L such that $\beta L \times 180°$. In this case, the variation in phase is now only about 14° as opposed to 30° over a bandwidth from 11 to 13 GHz.

Figure 9:
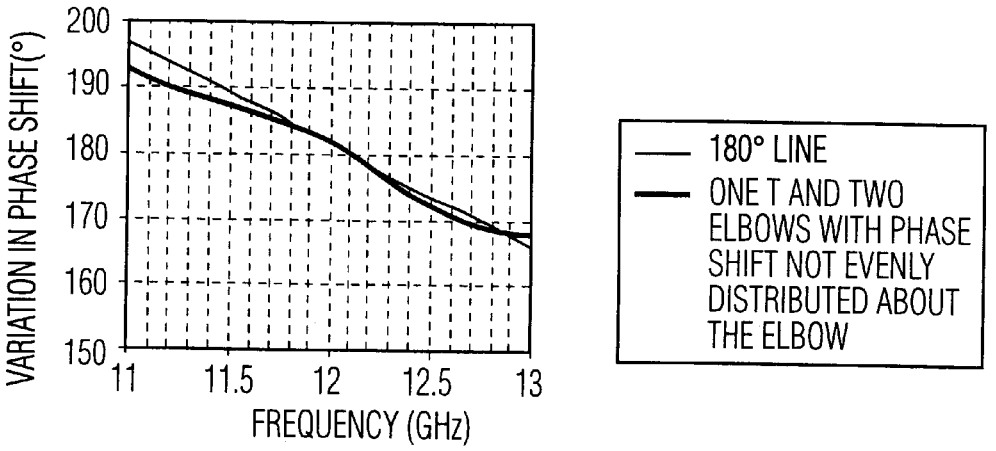

FIG. 9 depicts a T-circuit with a phase-shifting element with two bends, in which the phase shift $\Phi$ is not distributed evenly. As depicted in FIG. 9, it may be seen that, in this case, the variation in the phase shift is approximately identical to the variation in phase shift of a line at 180°.

Figure 10:
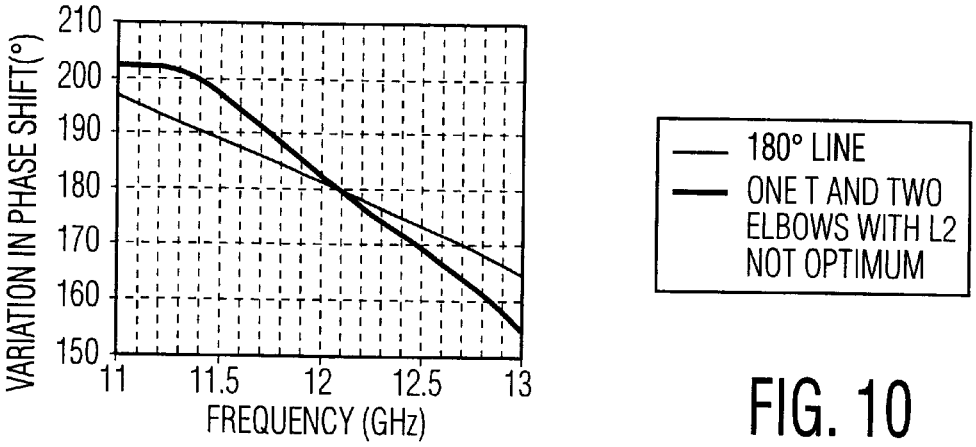

FIG. 10 simulates the case of a T-circuit with a phase-shifting element and two elbows in which the length of the two branches 20, 30 is not equal to $\lambda g/2$. It may be seen in this case that the variation in phase shift with frequency is greater than the phase shift of a line of length 180°.

Figure 11:
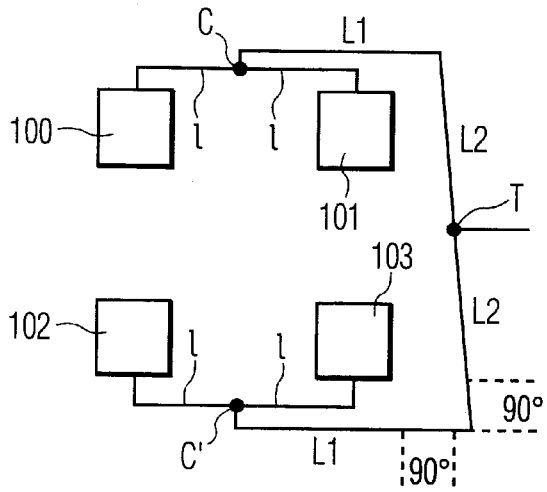
FIGS. 11 and 12 are two diagrammatic views from above of printed antennas using supply circuits produced using T-circuits according to the present invention.
Figure 12:
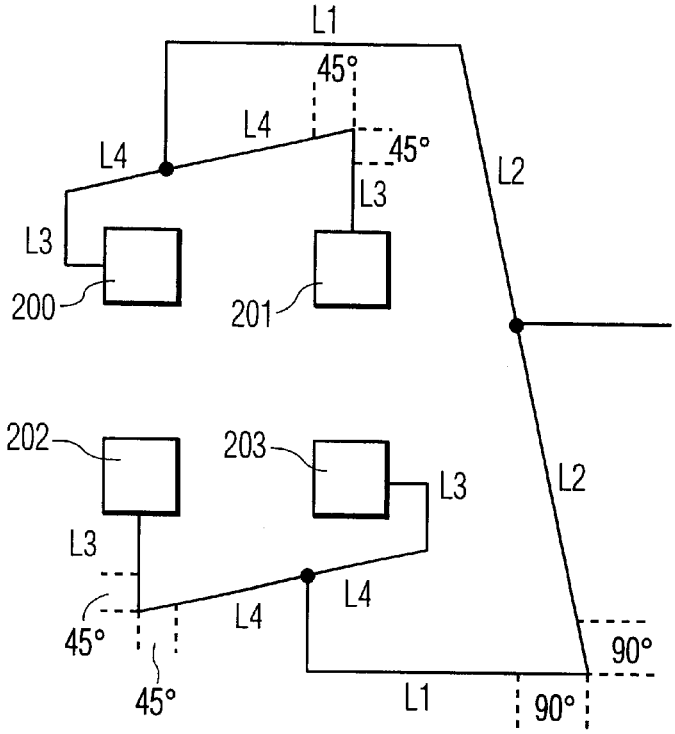

FIGS. 11 and 12 depict two exemplary applications using T-circuits with phase-shifting element such as those described hereinabove.

FIG. 11 depicts a printed antenna network with a supply circuit using a T-circuit with a phase-shifting element according to the present invention. More specifically, this is a four-patch network with printed patches 100, 101, 102, 103 connected to a supply circuit produced using microstrip technology. The network of the four patches 100, 101, 102, 103 is connected to each branch of the T as follows: the two patches 100, 101 are connected by line elements of identical length 1 to a point C and the two patches 102, 103 arc connected by line elements of identical length 1 to a point C'. These points C and C' form the ports P20 and P30 of a supply circuit consisting of a T-circuit with a phase-shifting element with two bends as described hereinabove. This supply circuit therefore comprises a T with two branches of length L2 $\times\lambda g/2$, one of the branches L2 being extended by a line element of length L1 as far as the point C while the other branch L2 is extended by a bend with a phase shift of 90° distributed evenly on each side of the bent, then by a line element L1 as far as the point of connection C'.

According to another embodiment, the present invention may be used as depicted in FIG. 12 with patch networks mounted in the known way in sequential rotation. More specifically, the printed antennas network comprises four patches 200, 201, 202, 203 connected in pairs with a first T-circuit with two bends which is produced as described hereinabove, the two T-circuits being connected by an additional T-circuit with two bends to an excitation source. More specifically, the patches 200 and 201 are connected together by a T-circuit with a phase-shifting element, giving a phase shift of 90° between the wave received by the patch 200 and the wave received by the patch 201. The same is true of the patches 202 and 203. This circuit therefore comprises two branches of length L4 equal to a multiple of λg/2, the branch connecting to the patch 200 being extended after a bend by a line element L3 while the other branch L4 is extended into line elements around the bend, produced in such a way as to give a line element L3. In the same way, the patch 203 is connected to the entry of the T by a line element L3 then, after a bend, by the branch L4 of length λg/2 while the patch 202 is connected by a line element L3 followed by a bend with line elements that give an evenly distributed phase shift of 45° and a branch of length L4 equal to λg/2. The two T-circuits described are connected to the excitation circuit by another T-circuit phase shift of 45° on each side, then by a comprising line elements L1 followed by a branch L2 of length equal to a multiple of λg/2 on one side and a line element L1 followed by a bend giving an evenly distributed phase shift of 90° on each side of the bend and a branch of length L2 × λg/2. As a result, a phase shift of 180° is obtained between the waves sent on the T-circuit supplying the patches 200 and 201 and the T-circuit supplying the patches 202 and 203.

The present invention can also be applied to other types of network such as phased networks and makes it possible to envisage networks attuned to a greater bandwidth than can be achieved with known circuits.

What is claimed is:

1. T-circuit designed in microstrip technology and operating in broadband, said T-circuit comprising two branches, one of the branches being extended by a phase-shifting element producing a given phase shift and the other branches being extended by a first bend, wherein the length L2 is equal to a multiple of λg/2 with λg the guided wavelength and the phase-shifting element is formed by a second of a length such that a phase shift of Φ/2 is distributed on each side of said second bend.

2. The T-circuit according to claim 1, wherein the phase-shifting element is formed by a microstrip line of length L ×Φ/β where β is the phase constant.

3. The T-circuit according to claim 2, wherein the phase-shifting element is extended by a line element of length L'1×L1 +$L_{bend}$ and the bend is extended by a line element of length L1.

4. The T-circuit according to claim 1, wherein the first and the second bends are each extended by a line element of identical length L1.

5. T-circuit designed in microstrip technology and operating in broadband, and T-circuit comprising two branches, one of the branches being extended by a phase-shifting element producing a given phase shift and the other branches being extended by a first bend, wherein the length L2 is equal to a multiple of λg/2 with λg the guided wavelength and the phase-shifting element is formed by a microstrip line of length L ×Φ/β wherein β is the phase constant and Φ the requested phase.

6. The T-circuit according to claim 5, wherein the phase-shifting element is extended by a line element of length L'1 × L1+$L_{bend}$ and the first bend is extended by a line element of length L1.

* * * * *